US006126751A

United States Patent [19]

Bernert et al.

[11] Patent Number: 6,126,751

[45] **Date of Patent: *Oct. 3, 2000**

[54] APPLICATION UNIT FOR DIRECTLY OR INDIRECTLY APPLYING A LIQUID OR PASTY MEDIUM TO A CONTINUOUS MATERIAL WEB

[75] Inventors: Richard Bernert, Giengen; Manfred Ueberschär, Nattheim, both of Germany

[73] Assignee: Voith Sulzer Papiermaschinen GmbH, Heidenheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,961

[22] Filed: Dec. 22, 1997

[30] Foreign Application Priority Data

Dec. 23, 1996 [DE] Germany ..... 296 22 365 U

[51] Int. Cl.[7] ..... B05C 5/02

[52] U.S. Cl. ..... 118/410; 118/413; 118/419; 118/712

[58] Field of Search ..... 118/410, 413, 118/419, 221, 224, 249, 261, 712; 427/356, 428; 425/461, 466, 467, 141, 190

[56] References Cited

U.S. PATENT DOCUMENTS

| | | | |
|---|---|---|---|
| 3,884,611 | 5/1975 | Anderson et al. | 425/466 |
| 4,143,187 | 3/1979 | Pilgrim et al. | 118/410 |
| 4,270,702 | 6/1981 | Nicholson | 239/455 |
| 4,990,079 | 2/1991 | Lorenz | 425/466 |
| 5,066,435 | 11/1991 | Lorenz et al. | 425/141 |
| 5,273,420 | 12/1993 | Gross et al. | 425/466 |
| 5,522,931 | 6/1996 | Iwashita et al. | 118/410 |
| 5,679,383 | 10/1997 | Ryan et al. | 425/141 |
| 5,788,998 | 8/1998 | Gross | 425/466 |

FOREIGN PATENT DOCUMENTS

| | | |
|---|---|---|
| 2060769 | 2/1992 | Canada . |
| 32 10 738 A1 | 3/1982 | Germany . |
| 38 08 698 A1 | 3/1988 | Germany . |
| 43 41 341 C1 | 12/1993 | Germany . |
| 44 32 177 A1 | 9/1994 | Germany . |

*Primary Examiner*—Laura Edwards
*Attorney, Agent, or Firm*—Taylor & Aust, P.C.

[57] ABSTRACT

The invention relates to an application unit for directly or indirectly applying a liquid or pasty medium (4) to a continuous material web (6), particularly one made of paper or cardboard, having two gap limiting walls (13, 14) that are spaced apart from one another, are each formed on corresponding lip members (2, 3) and between them define a metering gap (12) for the liquid or pasty medium (4), and having a gap-width adjustment device (8, 9) mated at least with the one lip member (2). There is provided on at least one gap limiting wall (13) an elastic adjustable wall member (7) which can be expanded into the metering gap (12) relative to the gap limiting wall (13), extends across the length of the metering gap (12) and can be actuated by the gap-width adjustment device (8, 9).

16 Claims, 3 Drawing Sheets

APPLICATION UNIT FOR DIRECTLY OR INDIRECTLY APPLYING A LIQUID OR PASTY MEDIUM TO A CONTINUOUS MATERIAL WEB

BACKGROUND OF THE INVENTION

A well-known application unit according to the class is described for example in DE 44 32 177 A1. Two elongated opposite lip members which between them define a metering gap are disposed on a support beam structure. The liquid or pasty medium to be applied is supplied under pressure to the metering gap via a feed gap via a distribution pipe; this metering gap is designed here as a free-jet nozzle. The medium to be applied leaves the free-jet nozzle metering gap in a free jet, and during so-called direct application this medium then directly strikes against the continuous material web to be coated and which is composed for example of paper, cardboard or a fabric material. In the case of so-called indirect application, the free jet first impacts against the surface of an application roll or another application surface, from which point the medium is transferred to the continuous web within a transfer gap through which the web is guided. At the metering gap outlet, the liquid or pasty medium is also frequently deflected in its direction of movement along a concavely curved deflection surface formed at one of the two lip members, before the medium is then applied in a free jet and at a specific impact angle to the material web or application surface.

To be able to adjust the metering gap width, an adjustment device is provided for at least one of the lip members in the free-jet nozzle application unit explained in DE 44 32 177 A1. In one embodiment version, the lip member to be adjusted is fitted with a thin section which acts as a hinge site. The adjustment device which e.g. comprises a number of adjusting spindles distributed over the lip member's length pivots the lip member around its thin section in order to adjusted the metering gap width in this way. In another embodiment, the lip member to be adjusted is slidably supported so that it can be slid by means of corresponding adjusting spindles toward or away from the facing lip member so as to adjust the gap width in this way. To create a flush transition between the slidable lip member's gap wall surface and feed gap's adjacent gap wall surface in the support beam structure, an elastic connecting strip is provided between the slidable lip member and the support beam. In these known application unit configurations, the gap width can be adjusted to locally varying degrees across the length of the metering gap in order thereby to achieve a profiling of the applied medium on the material web.

Although such known application units can be used to adjust the metering gap width with extreme accuracy, the associated adjustment mechanisms are difficult to design and can only be realized with corresponding costs.

SUMMARY OF THE INVENTION

The invention is therefore based on the technical problem of providing an application unit according to the class and simplified in terms of its structural design.

Whereas at least one lip member is always moved in conventional application units when adjusting the metering gap width, the invention is based upon the idea that when adjusting the gap, the lip members themselves can remain stationary if required and only an elastic adjustable wall member provided on a lip member's gap limiting wall is expanded into the metering gap in order thereby to control the metering gap width.

According to the invention, two lip members are therefore provided with gap limiting walls which between them define the metering gap. The adjustable wall member, which is provided on or in at least one gap limiting wall, is designed to be flexible and can be operated by a gap width adjustment device, so that depending on the desired gap width adjustment, this member can be deformed to a varyingly far extent into the metering gap. In other words, when adjusting the metering gap width, the separation or sharp edges of the lip members or the gap limiting walls, i.e. the free edges at which the free jet of medium emerges from the free-jet nozzle, therefore remain stationary in the solution according to the invention. The geometry of the gap limiting wall surface is preferably designed to be rigid, though the invention is not fixed to this version. The lip members as a whole may be adjustable in order to perform a basic adjustment of the gap width when starting up the facility. During operation, the lip members do, however, remain stationary and only the adjustable wall member is actuated for gap width control.

Whereas comparatively large adjustment forces have so far been necessary to move, i.e. to pivot or shift, a complete lip member for gap adjustment, only minimum forces are needed according to the invention in order to expand the elastic adjustable wall member more or less far into the metering gap. It is preferable for just the elastic adjustable wall member to be deformed and for the entire lip member no longer to be adjusted. The adjustable drives can therefore be implemented more inexpensively and with less outlay. Instead of the previous extremely expensive designs for the lip member flow surfaces, the flow strip geometry can be kept simpler and hence more cost-effective according to the invention, since the separation edges of the lip members now retain their relative position to one another during gap adjustment and an alteration to the gap geometry occurs only on the adjustable wall member.

The elastic adjustable wall member according to the invention can be integrated flush into the gap limiting wall of the associated lip member so that the flow of liquid or pasty medium through the metering gap is not interfered with by edges, projections or the like. The adjustable wall member extends across the length of the metering gap so as to enable an adjustment along the entire gap.

The elastic adjustable wall member expediently consists of a rubber material or an elastic synthetic material. To enable smooth continuous transitions from the adjustable wall member to the adjacent regions of the rigid gap limiting wall, the elastic adjustable wall member is prevulcanized to the associated gap limiting wall in a preferred embodiment. Alternatively, the adjustable wall member can be attached by form-locked integration into the lip member, by adhesion or in any other suitable manner.

In a beneficial embodiment, the adjustable wall member is shaped in the form of a belt or strip. This belt then extends along the metering gap. It is also possible for the adjustable wall member to be tube-shaped. Inside the tube, such a tube-shaped adjustable wall member can then be filled with liquids or gases whose pressure level is systematically varied to adjust the gap. That portion of the tube-shaped adjustable wall member which forms the elastic gap wall in the metering gap may also be belt-shaped or strip-shaped in an unloaded state.

The gap width adjustment device is preferably designed for an actuation of the adjustable wall member that locally differs across the length of the metering gap. The adjustable wall member can therefore be substantially expanded to a zonally varying degree. In this way, the cross-section of the layer of medium applied to the material web can be controlled. It is also preferable for the gap width adjustment device to be provided with an automatically actuatable drive. Yet it is also possible to provide a manually actuatable adjustment device.

In an expedient embodiment, the gap width adjustment device is arranged for a push- and/or pull-type actuation of the adjustable wall member. For this purpose, the gap width adjustment device comprises actuators for impingement upon the adjustable wall member so as to expand this member into the metering gap more or less substantially. Mechanical, pneumatic, hydraulic, electrical, magnetic, magnetic-inductive, piezoelectric, magnetostrictive, thermal actuators and the like as well as combined forms thereof are taken into consideration as actuators. For instance, in one embodiment version, the gap width adjustment device comprises plungers which have proved to be particularly suitable actuators. The plungers can in turn be driven in one or more of the manners generally described beforehand in conjunction with the actuators. To adjust the adjustable wall member in a locally different manner, a variety of individual plungers can be disposed across the length of the metering gap.

In another embodiment version, the gap width adjustment device and/or adjustable wall member comprises pneumatic or hydraulic pressure chambers. A locally varying gap width adjustment is for example possible by subdivision into separate pressure chambers. It is for example possible to provide individual, aligned pneumatic or hydraulic pressure chambers which impinge upon a continuous, e.g. belt-shaped adjustable wall member. Or a tube-shaped adjustable wall member can be divided into individual pressure chambers, the internal pressure of which can be adjusted to different degrees.

The adjustable wall member can be either designed as a member that is continuous across the length of the metering gap or it can be composed of individual segments.

In another beneficial embodiment, the gap width adjustment device is designed for push- and/or pull-type actuation. In expedient versions, the gap width adjustment device comprises adjusting spindles, traction/pressure pistons or similar adjustment assemblies which in the case of a locally differing gap width adjustment option, are distributed over the length of the metering gap. These adjustment assemblies can also be driven hydraulically, pneumatically, electrically, magnetic-inductively, mechanically, thermally or in any other way.

The gap width adjustment device is preferably integrated into an automatic control loop. A measurement device is provided which detects actual values of a profile—applied by the application unit—of the liquid or pasty medium. A control computer unit is also provided which receives the actual values from the measurement device and compares them with specified target values of the applied layer's desired profile. In accordance with the ascertained deviations between target and actual values, the control computer unit forwards control variables to the adjustment device in order to readjust accordingly the adjustment assemblies for actuating the adjustable wall member.

Since according to the invention, an elastic adjustable wall member is adjust rather than the entire, comparatively deflection-resistant lip member, it is possible to increase the division between the individual adjustment assemblies, i.e. for example adjusting spindles or adjustment pistons, with respect to conventional designs. A larger number of adjustment assemblies can therefore be disposed across the length of the metering gap, since short-wave adjustment profiles can also be implemented in the case of the elastic adjustable wall member. In the case of conventional designs, however, the elastic bending stress limit of the lip member to be adjusted to locally varying extents sets limits to improving the division, since far too short-wave adjustment profiles can no longer be performed without the risk of a plastic deformation of the lip member. A much finer gap adjustment across the length of the metering gap is therefore possible according to the invention. The gap adjustment can also be performed with considerably lesser adjusting forces, which in turn results in a simplified design for the adjustment assemblies. For example, more inexpensive adjustment assemblies can therefore be realized. There is also the advantage that the free-jet nozzle's geometry in the area of the separation edges remains unchanged despite different gap width adjustments, simplifying application unit control.

The solution according to the invention can also be used to adjust the gap of the nozzle system in the headbox of a paper-making machine or to adjust the gap of a coating nozzle. The solution according to the invention can equally be applied to advantageous effect in application units which comprise at least one roller doctor or coating blade as application members.

BRIEF DESCRIPTION OF THE DRAWINGS

Preferred embodiments of the application unit according to the invention will be explained in more detail as follows with additional design details and other advantages with reference to the attached drawings.

DETAILED DESCRIPTION OF THE INVENTION

To avoid repetitions, identical parts and components will also be identified by the same reference symbols in the following description and Figures, unless further differentiation is necessary.

Figure 1:
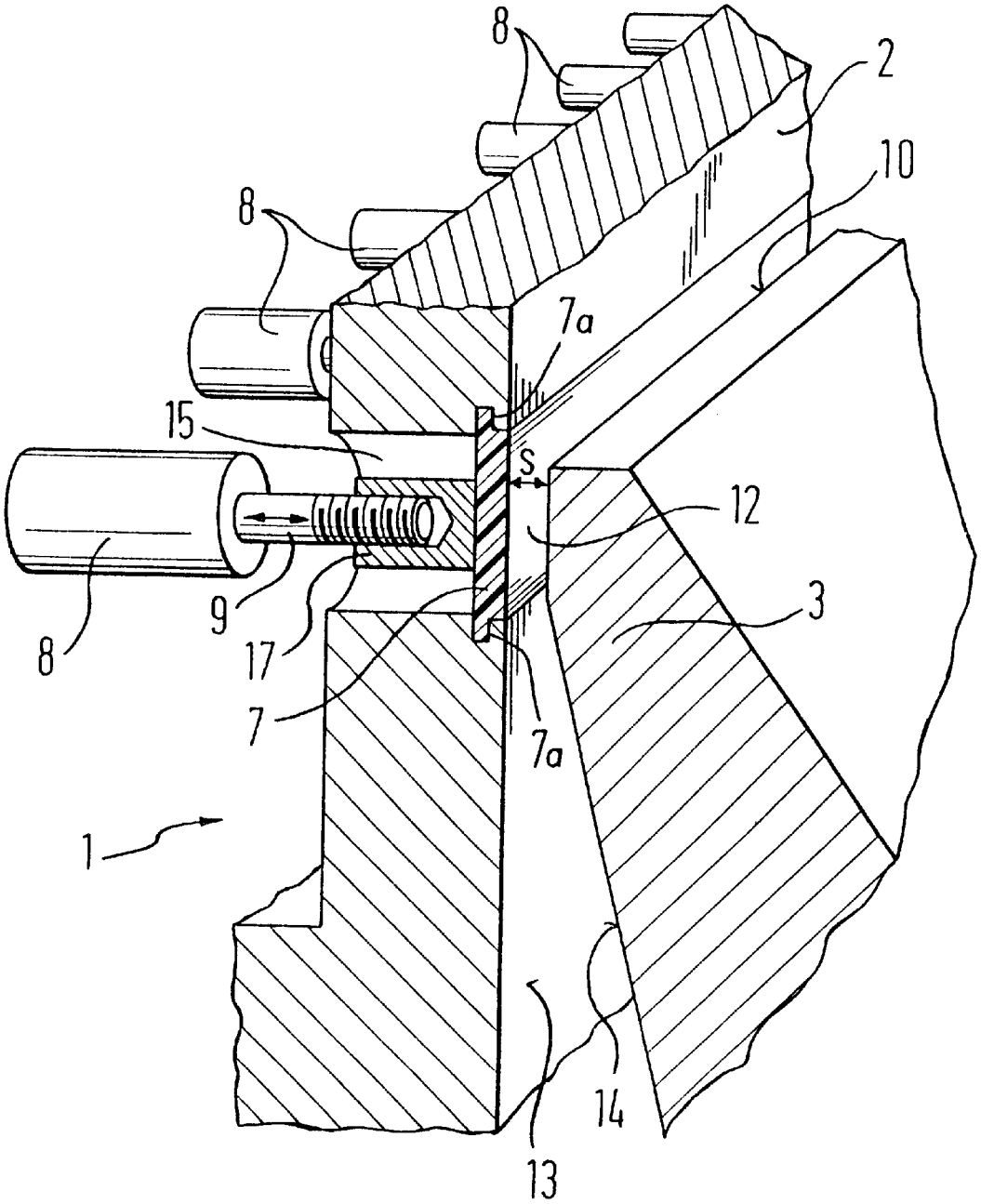
FIG. 1 shows a first exemplary embodiment of the application unit according to the invention in a schematic partially sectional perspective view.
Figure 2:
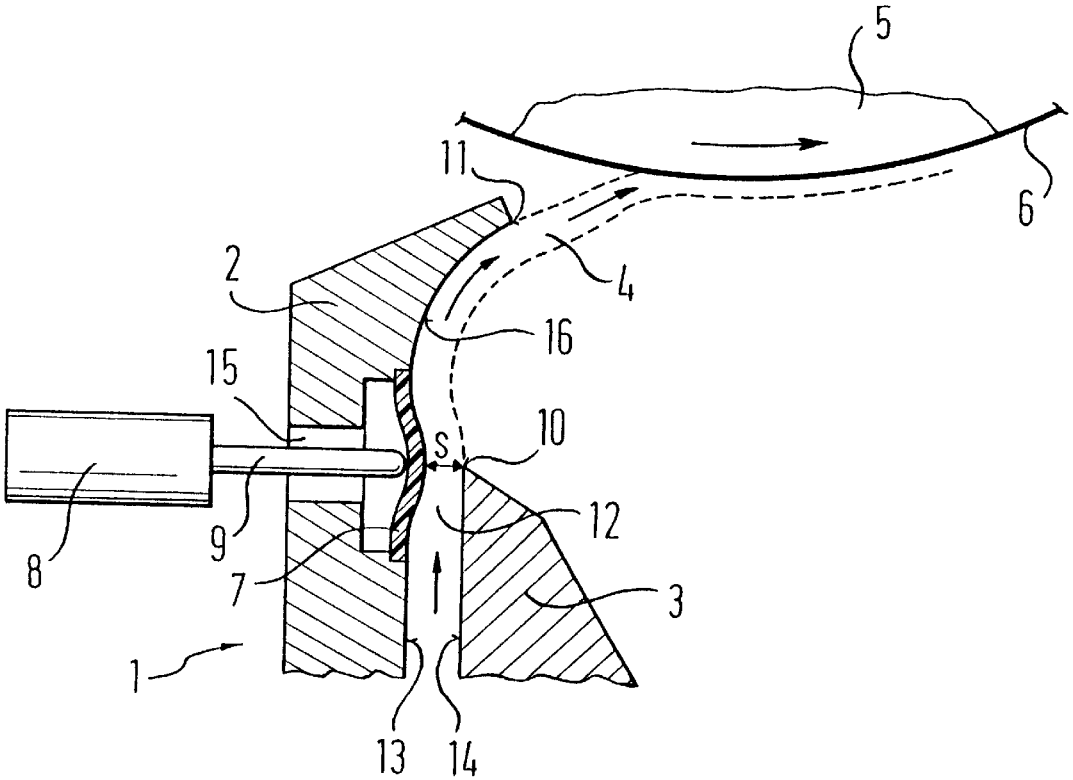
FIG. 2 a schematic diagram to explain the operating mode of the first exemplary embodiment in FIG. 1.

FIGS. 1 and 2 show a first exemplary embodiment of the application unit according to the invention, whereby the cross-sectional view in FIG. 2 is somewhat simplified in order to illustrate the operating mode. The application unit 1 comprises two lips 2 and 3 spaced apart from one another and extending across the width of a material web 6 to be coated, e.g. a paper web. A gap limiting surface 13, 14 is respectively formed at the lips 2 and 3. The gap limiting surfaces 13, 14 define between them a metering gap 12 which is formed here as a free-jet nozzle metering gap. A adjustable wall member in the form of a belt 7 made of an elastic material is provided in the lip 2. The belt 7 is integrated flush into the gap limiting wall 13 so that along the gap limiting wall 13, flush transitions exist between the elastic belt 7 and the rigid gap limiting wall portions formed at the lip 2 and which do not interfere with the flow of a liquid or pasty medium 4 that flows past.

As can be seen in FIG. 1, the belt 7 is positively fitted into the lip 2 and for example additionally prevulcanized or affixed thereto. The belt 7 extends along the lip 2 across the entire metering gap 12. The width of metering gap 12 in the area of the belt 7 is marked by the reference symbols. Each of the two lips comprises a separation edge 10 or 11 at which the flow of liquid or pasty medium 4 separates from the limiting walls 13, 14 and merges into a free jet. The flow direction of the medium 4 is marked by arrows (FIG. 2). The medium 4 itself is indicated in the area of flow after the separation edges 10, 11 by broken lines in its course of flow. A concavely curved deflection portion 16 is formed at the gap limiting wall 13 in the flow direction after the belt 7.

The elastic belt 7 is mated with an adjustment device that comprises a plurality of adjustment assemblies 8, 9 so as to expand the belt into the metering gap 12. The adjustment device makes it possible for the belt 7 to be substantially expanded into the metering gap to locally varying degrees across the length of the belt 7 in order to adjust the gap width s correspondingly across the length of the metering gap in a locally varying manner. The plurality of adjustment assemblies 8, 9—which have a predetermined division, i.e. predetermined intervals between two adjacent adjustment assemblies—is provided for this purpose along the lip 2 and across the length of the metering gap. The adjustment assemblies comprise automatically actuatable drives 8, e.g. hydraulic or pneumatic actuators which can adjust associated adjustment spindles or pistons 9 in the direction of the dual arrow (see FIG. 1). The adjustment pistons 9 are therefore effective transverse to the associated plane of the metering gap 12. As is evident from FIG. 1, the adjustment pistons 9 are for example screwed to the rear of the elastic belt 7. Attachment pins 17 are respectively provided for this purpose on the rear side of the belt 7 at the positions of the adjustment assemblies. These attachment pins 17 and the ends connected thereto of the adjustment pistons 9 are accommodated in corresponding apertures 15 of the lip 2.

As indicated in FIG. 2, the application unit 1 is mated with a counter-roll 5 rotating in the direction of the arrow and on whose surface the material web 6 to be coated is supported. The aforementioned application unit 1 relates to a free-jet nozzle application unit which applies the liquid or pasty medium 4 to be applied in a free jet to the material web 6 which passes by the counter-roll 5. Looking across the material web width, the medium is applied with a specific cross section, i.e. the quantity of medium 4 applied varies across the length of the metering gap 12 in a predetermined manner. To do so, the gap width s has to be correspondingly adjust along the metering gap. This happens in that by means of their adjustment pistons 9, the adjustment assemblies push the adjustable wall member, i.e. the elastic belt 7, far into the metering gap 12 to locally differing extents, which is illustrated in FIG. 2 for the depicted cross section. By integrating the elastic belt 7 into the gap limiting wall 13, the gap can be locally adjusted with minimum forces and with extreme precision. The high elasticity of the belt 7 makes it possible to dispose the adjustment assemblies 8, 9 in an extremely fine division, i.e. at very small intervals. The elastic belt 7 therefore also enables very short-wave adjustment profiles along the metering gap. In the case of the form-locked attachment of the adjustment pistons 9 to the belt 7, it is also possible not only—if necessary—to push the belt into the metering gap but also to push it out of the metering gap, i.e. to the left in the Figures.

During gap adjustment, the two lips 2, 3 with the associated separation edges 10, 11 therefore remain stationary and only the elastic belt 7 is adjusted. A comparatively simple adjustment mechanism which can be designed extremely compactly using few components is therefore obtained.

Figure 3:
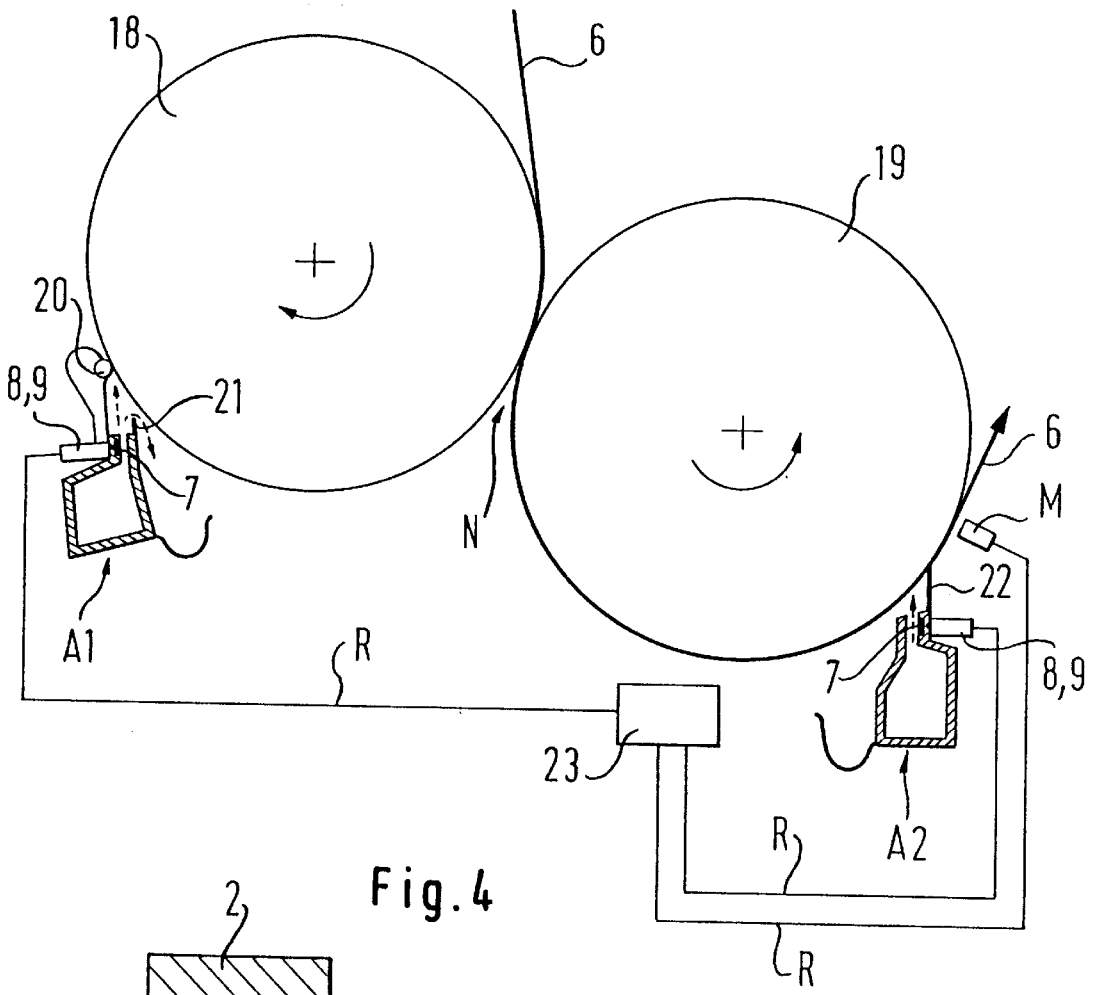
FIG. 3 a schematic, considerably simplified side view of a second exemplary embodiment of the application unit according to the invention.

In a schematic and highly simplified side view, FIG. 3 shows a second exemplary embodiment of the application unit according to the invention and used to produce a one-sided (i.e. present only on one side of the material web) double layer of liquid or pasty medium. This version comprises two facing rolls 18, 19 which between them form a gap N through which the continuous material web 6 is guided before running across a partial section of the circumference of the roll 19. Each roll 18, 19 is mated with an application assembly A1, A2. The application assembly A1 belonging to the roll 18 that acts as an application roll is designed as a kind of chamber application unit and also has a adjustable wall member 7 disposed according to the invention between two limiting walls which form a gap; this wall member can be expanded into the gap. The application assembly A1 is also fitted with a roller doctor element 20 and an overflow 21. On the other hand, the application assembly A2 mated with the roll 19 that acts as a counter-roll is designed as a free-jet nozzle metering gap assembly, as has already been described in conjunction with FIG. 1. A coating blade 22 is also provided in the area of the trailing lip of the metering gap of A2.

In the exemplary embodiment shown in FIG. 3, the liquid or pasty medium is first applied to the roll 18 and then applied inside the roll gap N to the continuous material web 6, i.e. the medium is indirectly applied here. The first application layer is therefore produced. The material web 6 provided with the first layer moves further on to the assembly A2 at which the second layer is then applied to the already existing first layer in a direct application and by means of the coating blade 22, thereby producing the aforementioned double layer on the material web 6.

As can also be identified in FIG. 3, the adjustment devices 8, 9 are integrated into an automatic control loop R that has a measurement device M for detecting the actual values of the medium's applied double-layer profile and a control computer unit 23 for ascertaining control variables for the adjustment device based on an alignment of the actual values with predetermined target values. Although the measurement device M was provided here only for the detection of the resultant double layer, it is apparent that corresponding measurement devices can also, of course, be provided for each individual layer of those layers building up the double or multiple layer.

Figure 4:
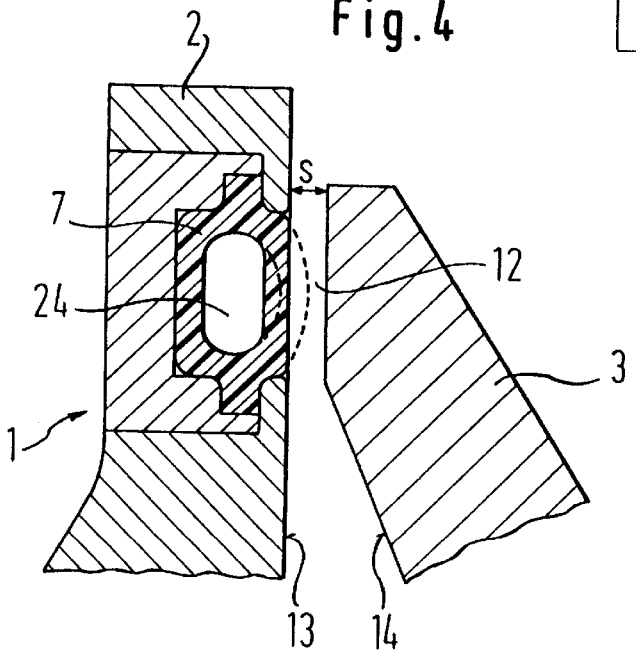
FIG. 4 a schematic sectional view of a third exemplary embodiment of the application unit according to the invention.

FIG. 4 shows a schematic sectional view of a third exemplary embodiment of the application unit according to the invention. This version essentially resembles that according to FIG. 1, but in contrast the adjustable wall member 7 comprises one or more pressure chambers 24 to be acted upon by a pressure medium, allowing the adjustable wall member 7 to be correspondingly deformed (shown in FIG. 4 by the broken line) and hence the metering gap 12 to be adjusted. The drives 8 or adjustment pistons 9 shown in FIG. 1 can be dispensed with here. Suitable supply lines for the pressure medium must, however, be provided.

The invention is not restricted to the above exemplary embodiments which merely serve to explain in general terms the invention's basic idea. On the contrary, as part of the scope of protection, the application unit according to the invention can also assume embodiments other than those described above. Application versions in which there takes place a one-sided simple application or an application on both sides, e.g. in an application gap, are of course possible as well.

Reference symbols in the description, abstract and drawings merely help to improve comprehension of the invention and are not intended to limit the extent of protection.

What is claimed is:

1. An application unit for directly or indirectly applying a liquid or pasty medium to a continuous material web comprising:

two gap limiting walls spaced apart from one another, each formed on associated lip members and which between them define a metering gap for the liquid or pasty medium, and a gap-width adjustment device mated with at least one said lip member, wherein there is provided on at least one gap limiting wall an elastic adjustable wall member that can be expanded into said metering gap relative to said gap limiting wall, said wall member extending across the length of said metering gap and being actuatable by said gap-width adjustment device, said at least one gap limiting wall including a groove structure therein opening in a direction substantially parallel to said metering gap, said elastic adjustable wall member having at least two portions thereof fitted in opposing portions of said groove structure and attached to said at least one said gap limiting wall.

2. An application unit according to claim 1, wherein said elastic adjustable wall member consists of a rubber material or an elastic synthetic material.

3. An application unit according to claim 2, wherein said adjustable wall member is prevulcanized to said associated gap limiting wall.

4. An application unit according to claim 1, wherein said adjustable wall member is belt-shaped.

5. An application unit according to claim 1, wherein said gap-width adjustment device is designed for actuating said adjustable wall member to locally varying extents across the length of said metering gap.

6. An application unit according to claim 1, wherein said gap-width adjustment device is fitted with an automatically actuatable drive.

7. An application unit according to claim 1, wherein said gap-width adjustment device is designed for push-type actuation of said adjustable wall member.

8. An application unit according to claim 7, wherein said gap-width adjustment device comprises pressure pistons.

9. An application unit according to claim 7, wherein said gap-width adjustment device comprises pneumatic or hydraulic pressure chambers.

10. An application unit according to claim 1, wherein said adjustable wall member comprises pneumatic or hydraulic pressure chambers.

11. An application unit according to claim 1, wherein said gap-width adjustment device is designed for push- and pull-type actuation.

12. An application unit according to claim 11, wherein said gap-width adjustment device comprises adjustment spindles.

13. An application unit according to claim 11, wherein said gap-width adjustment device comprises traction/pressure pistons.

14. An application unit according to claim 1, wherein said gap-width adjustment device is integrated into an automatic control loop having measurement means for detecting actual values of an applied profile of said medium and a control computer unit for ascertaining control variables for said gap-width adjustment device based on an alignment of the actual values with predetermined target values.

15. An application unit according to claim 1, wherein said elastic adjustable wall member is disposed within said groove so as to be substantially level with a top of said at least one gap limiting wall when said elastic adjustable wall member is in an unexpanded state.

16. An application unit according to claim 1, wherein said at least one gap limiting wall has a concave upper deflection portion.

* * * * *

UNITED STATES PATENT AND TRADEMARK OFFICE

CERTIFICATE OF CORRECTION

PATENT NO. : 6,126,751

DATED : October 3, 2000

INVENTOR(S) : Richard Bernert, et al.

It is certified that error appears in the above-identified patent and that said Letters Patent is hereby corrected as shown below:

COVER SHEET

Under "Foreign Application Priority Data", delete "365 U" and substitute --365.4-- therefor.

COLUMN 1

After "BACKGROUND OF THE INVENTION", insert --The invention relates to an application unit for directly or indirectly applying a liquid or pasty medium to a continuous material web, particularly made of paper or cardboard.--

COLUMN 4

Line 66, after "2", insert --in grooves 7a--.

COLUMN 5

Line 3, delete "symbols" and substitute --symbol s.-- therefor.

UNITED STATES PATENT AND TRADEMARK OFFICE

CERTIFICATE OF CORRECTION

PATENT NO. : 6,126,751

DATED : October 3, 2000

INVENTOR(S) : Richard Bernert, et al.

It is certified that error appears in the above-identified patent and that said Letters Patent is hereby corrected as shown below:

COLUMN 8

Line 2, delete "push-type" and substitute --push-- therefor; and

Line 13, delete "push- and pull-type" and substitute --push and pull -- therefor.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*